US009541896B2

(12) United States Patent
Uehara

(10) Patent No.: US 9,541,896 B2
(45) Date of Patent: Jan. 10, 2017

(54) FIXING DEVICE THAT ENSURES DOWNSIZED OPENING/CLOSING SPACE OF FIXING COVER AND IMAGE FORMING APPARATUS

(71) Applicant: Kyocera Document Solutions Inc., Osaka (JP)

(72) Inventor: Masakazu Uehara, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/929,193

(22) Filed: Oct. 30, 2015

(65) Prior Publication Data

US 2016/0124382 A1 May 5, 2016

(30) Foreign Application Priority Data

Oct. 30, 2014 (JP) ..... 2014-221717

(51) Int. Cl.
*G03G 15/20* (2006.01)
*G03G 21/16* (2006.01)

(52) U.S. Cl.
CPC ..... *G03G 21/1685* (2013.01); *G03G 15/2017* (2013.01)

(58) Field of Classification Search
CPC ..... G03G 21/1685; G03G 15/6573; G03G 21/1647
USPC ..... 399/122, 21
See application file for complete search history.

(56) References Cited

U.S. PATENT DOCUMENTS 7,574,158 B2 * 8/2009 Uehara ..... G03G 15/234 399/122
8,340,535 B2 * 12/2012 Uehara ..... G03G 15/6529 399/122
9,025,973 B2 * 5/2015 Suzuki ..... G03G 21/1633 399/122
2014/0255065 A1 * 9/2014 Takahashi ..... G03G 15/2064 399/329

FOREIGN PATENT DOCUMENTS

JP 2009-251309 A 10/2009
JP 2012-194331 A 10/2012

* cited by examiner

*Primary Examiner* — Billy Lactaoen
*Assistant Examiner* — Arlene Heredia Ocasio
(74) *Attorney, Agent, or Firm* — James Judge

(57) ABSTRACT

A fixing device includes a fixing device main body and a fixing cover. The fixing device main body has an opening across a back portion and an upper portion of a conveying passage of a recording sheet. The fixing cover openably/closably covers the opening by rotatably supported with a first axle as a rotational central axle. The first axle extends in width direction of the recording sheet in a lower end of the back portion of the opening. The fixing cover includes a first fixing cover portion and a second fixing cover portion. The first fixing cover portion covers the back portion of the conveying passage and its lower end portion is rotatably supported with the first axle as the rotational central axle. The second fixing cover portion covers the upper portion of the conveying passage and has a bendable structure with respect to the first fixing cover portion.

8 Claims, 23 Drawing Sheets

3

FIXING DEVICE THAT ENSURES DOWNSIZED OPENING/CLOSING SPACE OF FIXING COVER AND IMAGE FORMING APPARATUS

INCORPORATION BY REFERENCE

This application is based upon, and claims the benefit of priority from, corresponding Japanese Patent Application No. 2014-221717 filed in the Japan Patent Office on Oct. 30, 2014, the entire contents of which are incorporated herein by reference.

BACKGROUND

Unless otherwise indicated herein, the description in this section is not prior art to the claims in this application and is not admitted to be prior art by inclusion in this section.

As a fixing device, there is known a structure that includes: a fixing device main body having a nip area constituted of a heating roller and a pressure roller and having an opening exposing the nip area; and a fixing cover covering the opening openably/closably. This fixing cover covers a back portion and an upper portion of the fixing device main body and also causes the nip area to expose by rotating around an axle located in a lower portion of the back portion. In such fixing device, when a paper jam (hereinafter referred to as "JAM") of a recording sheet occurs inside, the recording sheet is removed after rotating the fixing cover to cause the nip area to be exposed.

SUMMARY

A fixing device according to one aspect of the disclosure includes a fixing device main body and a fixing cover. The fixing device main body has an opening across a back portion and an upper portion of a conveying passage of a recording sheet. The fixing cover openably/closably covers the opening by rotatably supported with a first axle as a rotational central axle. The first axle extends in a width direction of the recording sheet in a lower end of the back portion of the opening. The fixing cover includes: a first fixing cover portion and a second fixing cover portion. The first fixing cover portion covers the back portion of the conveying passage. A lower end portion of the first fixing cover portion is rotatably supported with the first axle as the rotational central axle. The second fixing cover portion covers the upper portion of the conveying passage. The second fixing cover portion has a bendable structure with respect to the first fixing cover portion.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
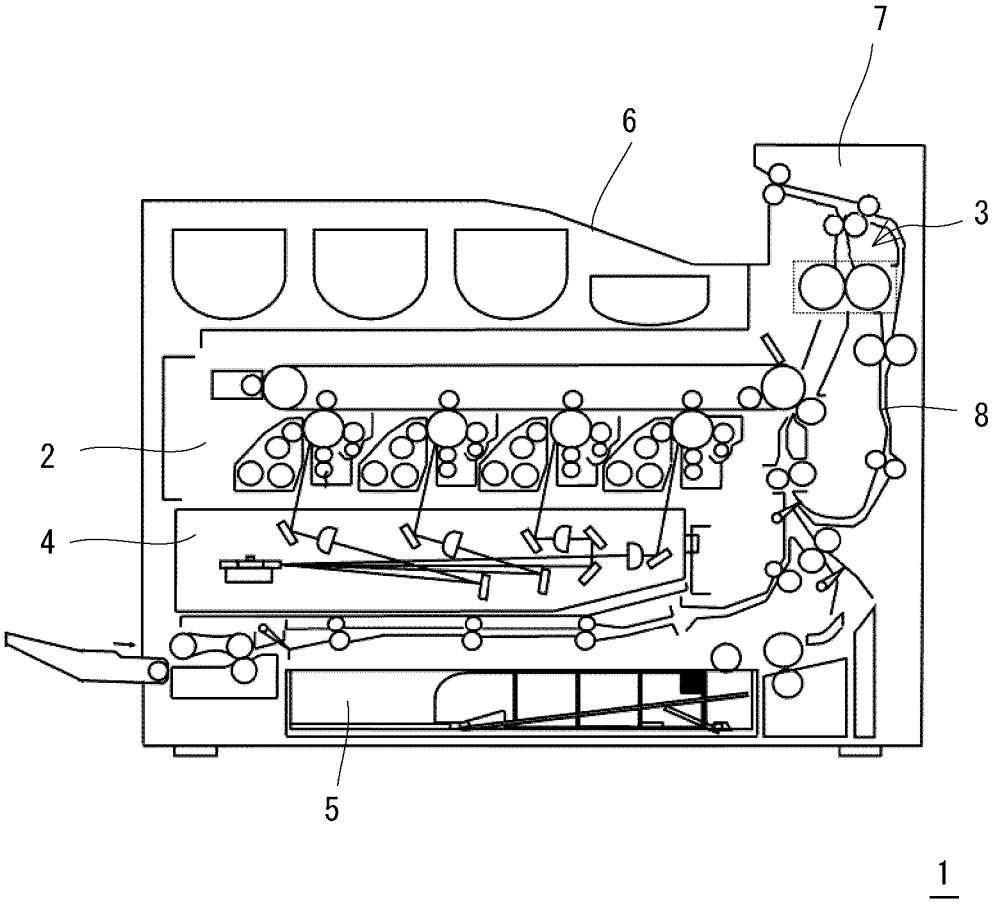
FIG. 1 schematically illustrates a cross section of an image forming apparatus according to one embodiment.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes a fixing device according to one aspect of the disclosure and one embodiment of an image forming apparatus including the fixing device with reference to the drawings.

1. Outline of Image Forming Apparatus

An image forming apparatus 1, as illustrated in FIG. 1, includes an image forming unit 2 forming a toner image on a recording sheet and a fixing device 3 fixing the formed toner image and also includes: an image reading unit 4 reading an image of a document that is set; a paper sheet feeder 5 feeding the recording sheet to the image forming unit 2; a discharge unit 7 discharging the recording sheet with the toner image fixed to a discharge tray 6; an operation display unit for performing a display of various kinds of functions, a selection operation of the various kinds of functions, and similar operation; and a control unit controlling the respective units for performing a selected function.

The image forming apparatus 1 forms a color image with a tandem type. The image forming apparatus 1 is a type capable of forming an image on both sides of a recording sheet (that is, duplex printing), and has a switchback function causing the front and back of the recording sheet with the image fixed on one surface to be inverted, and has an inverting conveyance path 8 for feeding of the inverted recording sheet to the image forming unit 2. Here, the inverting conveyance path 8 is "C"-shaped along a back surface of the image forming apparatus 1, what is called, "back surface C path."

2. Fixing Unit (1) Outline of Overall Structure

Figure 2:
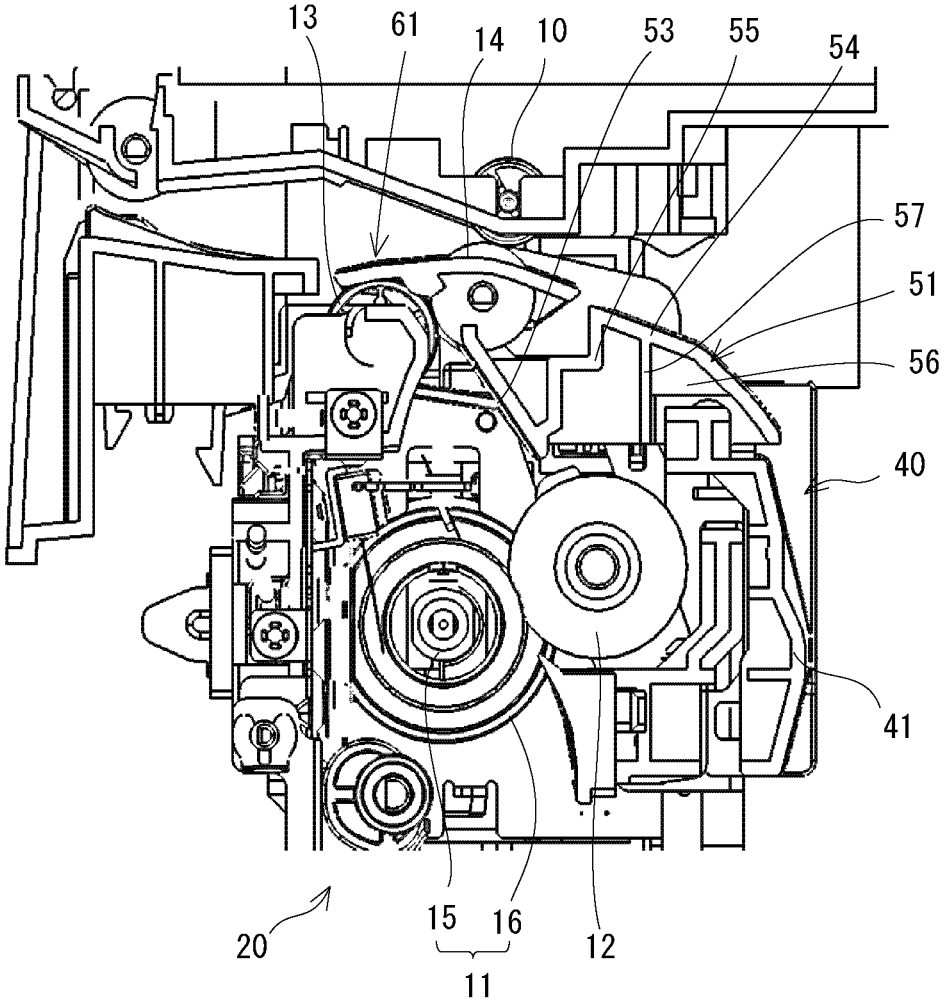
FIG. 2 schematically illustrates a cross section of a fixing device according to the one embodiment.
Figure 3A:
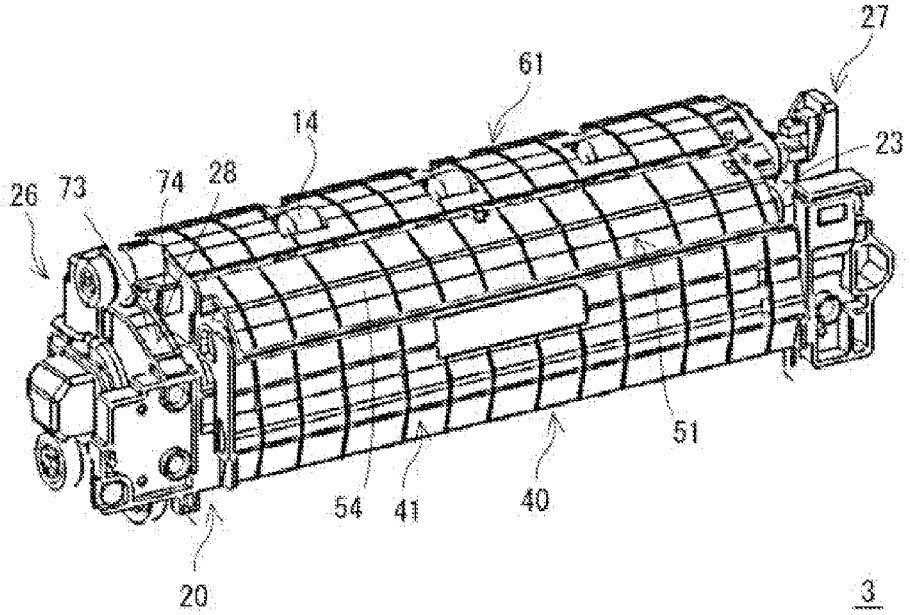
FIGS. 3A and 3B perspectively illustrate the fixing device in a closed state according to the one embodiment.
Figure 3B:
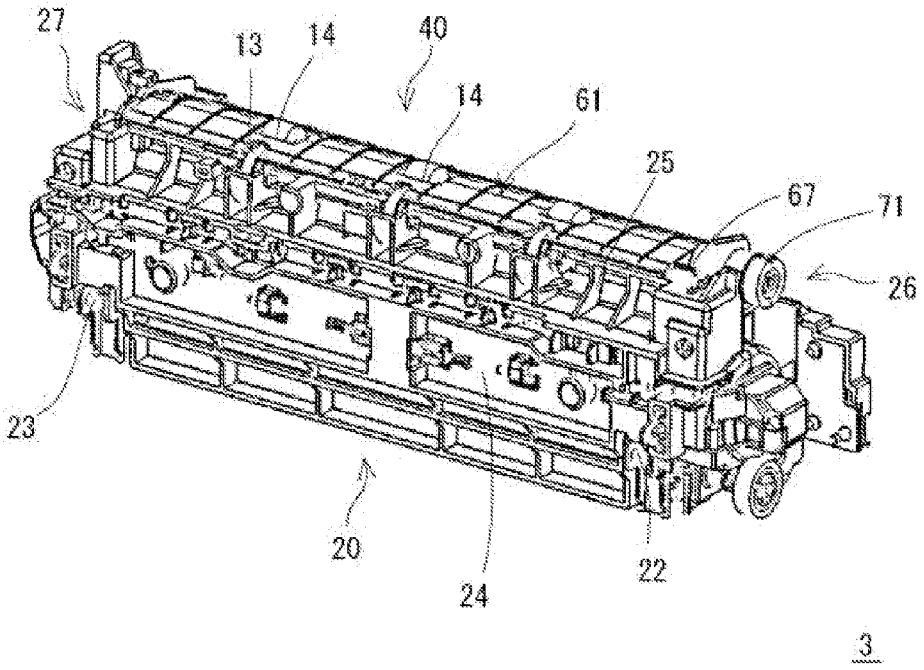
Figure 4A:
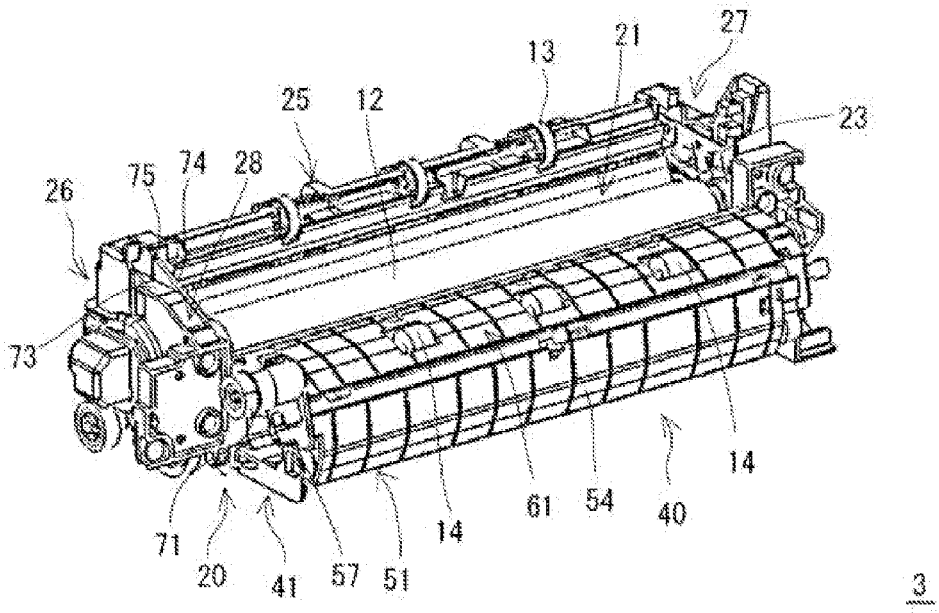
FIGS. 4A and 4B perspectively illustrate the fixing device in an open state according to the one embodiment.
Figure 4B:
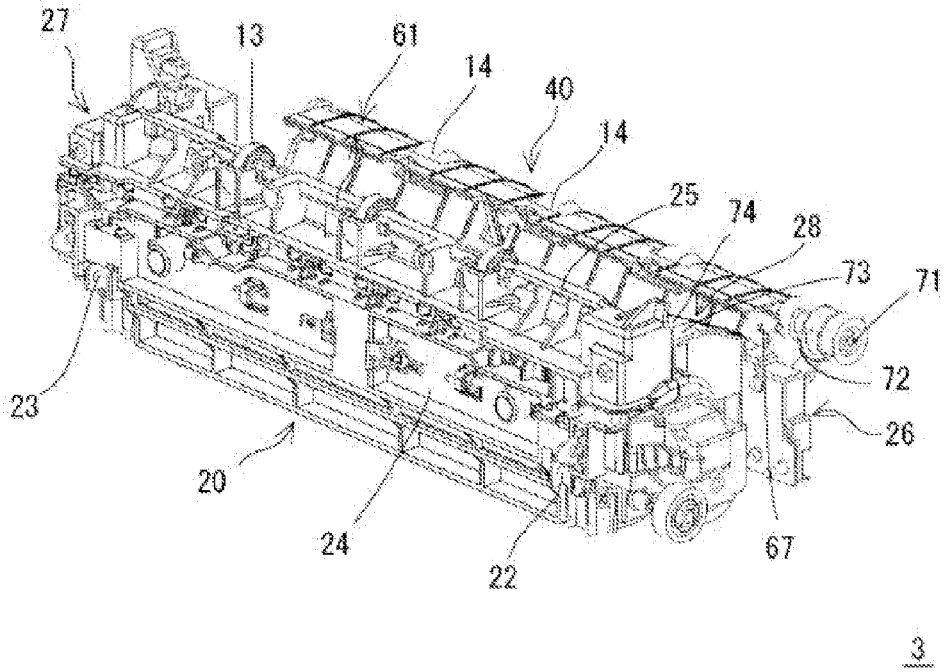

The fixing device 3 corresponds to an exemplary fixing device according to the disclosure, and is incorporated removably as the fixing unit constituting a part of the image forming apparatus. The following describes the fixing unit as the fixing device. The fixing device 3, as illustrated in FIG. 2, includes a heat roller 11, a press roller 12, and a pair of discharge rollers 13 and 14. The heat roller (corresponding to a heating roller) 11 and the press roller (corresponding to a pressure roller) 12 constitute a nip area. Axes of the heat roller 11, the press roller 12, and the discharge rollers 13 and 14 extend in parallel, and extending directions of the axes of these rollers and a direction parallel to the extending directions are hereinafter simply referred to as "axial directions of the rollers or an axial direction." The fixing device 3 causes a recording sheet received from a lower side to pass between the heat roller 11 and press roller 12, and then discharges the recording sheet with use of the pair of discharge rollers 13 and 14 from a front portion side in an upper portion. This ensures heating of the recording sheet by the heat roller 11 and fixing of the toner image on the recording sheet.

In a conveying passage where the recording sheet passes an inside of the fixing device 3 (see FIG. 7A), a supply side to the fixing device 3 is an upstream side, and a discharge side is a downstream side. A direction where the recording sheet travels from the upstream side to the downstream side of the fixing device 3 and a direction parallel to the direction are referred to as "a travelling direction of the recording sheet or a travelling direction," and a direction perpendicular to the travelling direction is referred to as "a width direction of the recording sheet or a width direction." The width direction of the recording sheet and the axial directions of the rollers are the identical directions. The heat roller 11 is a combination of a heat source and a heat transfer member conducting heat from the heat source. Here, a halogen lamp 15 is used as the heat source, and a roller 16 is used as the heat transfer member. The halogen lamp 15 is inserted inside the roller 16.

The fixing device 3, as illustrated in FIGS. 3A and 3B and FIGS. 4A and 4B, includes a fixing device main body 20 and a fixing cover 40: the fixing device main body 20 has an opening 21 across a back portion and a upper portion of the conveying passage of the recording sheet; and the fixing cover 40 openably/closably covers the opening 21 being rotatably supported by a first axle, which extends in the width direction of the recording sheet in a lower end of a back portion of the opening 21, as a rotational central axle. Here, a state where the opening 21 is closed by the fixing cover 40 is referred to as "a closed state," and a state where the opening 21 is opened by the fixing cover 40 is referred to as "an open state." When the recording sheet passing the inside gets stuck (when JAM occurs), the opening 21 is used to remove the recording sheet which is stuck. The fixing cover 40 has a first fixing cover portion 41, which mainly covers the back portion of the conveying passage of the recording sheet and a lower end portion of which is rotatably supported by a first axle 29 as a rotational central axle, and a second fixing cover portion 51, which mainly covers the upper portion of the conveying passage, and the second fixing cover portion 51 has a bendable structure with respect to the first fixing cover portion 41. The first fixing cover portion 41 is also referred to as a first fixing cover, and the second fixing cover portion 51 is also referred to as a second fixing cover.

(2) Fixing Device Main Body

Figure 5A:
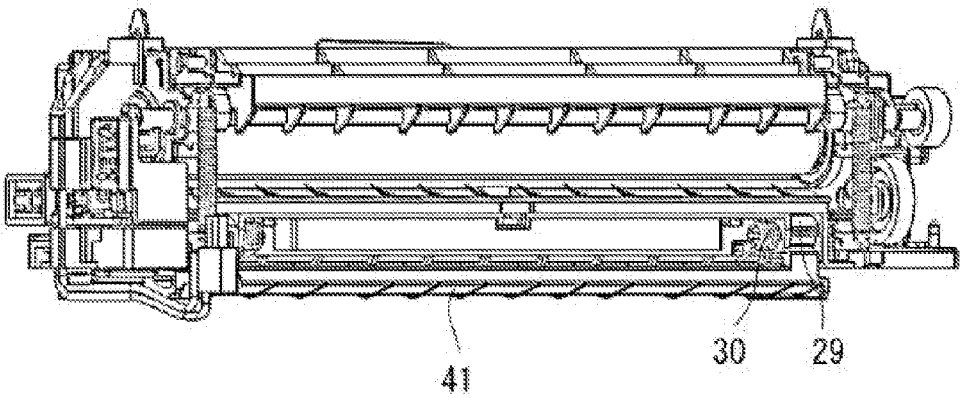
FIG. 5A perspectively illustrates a bottom side of the fixing device according to the one embodiment.

The fixing device main body 20 includes the aforementioned heat roller 11, press roller 12, and the discharge roller 13 as one of the pair of discharge rollers 13 and 14. The fixing device main body 20 has a frame for holding the heat roller 11 and the press roller 12. The frame has a pair of supporting portions 22 and 23 supporting the heat roller 11 and the press roller 12 in an end portion in the axial direction and a connecting portion 24 connecting the pair of supporting portions 22 and 23. The connecting portion 24 is located on a front face side of the fixing device main body 20 (fixing device 3). The fixing device main body 20 has an upper housing 25 where an axle, in which the discharge roller 13 is installed, is mounted, in an upper portion of the frame. A structure that the discharge roller 13 is mounted onto an axle supported by the pair of supporting portions 22 and 23 may be applicable. The fixing device main body 20 has side covers 26 and 27 on a facing side (inside) and an opposite side (outside) in the pair of supporting portions 22 and 23. In the side covers 26 and 27, the following are installed: a fixing portion fixing a position of the fixing device 3 when the fixing device 3 is installed in the image forming apparatus 1; a drive transmission portion transmitting drive to the heat roller 11 from a driving unit inside the image forming apparatus 1; and similar portion. The fixing device main body 20 may have a structure that the side covers 26 and 27 double as the pair of supporting portions 22 and 23. A top surface of at least one side cover (here, the side cover 26) between the side covers 26 and 27 is a support region 28 supporting the fixing cover 40. The structure of the support region 28 will be described together with the fixing cover 40 described below. The fixing device main body 20, as illustrated in FIG. 5A, has the first axle 29 in the lower end portion of the back surface of the fixing device main body 20. The first axle 29 is located in the pair of supporting portions 22 and 23 such that the first axle 29 extends inside the pair of supporting portions 22 and 23. Although the first axle 29 is constituted of two axes, and each axle is located in the pair of supporting portions 22 and 23, it may be constituted of, for example, one axle extending over the supporting portions 22 and 23.

Figure 5B:
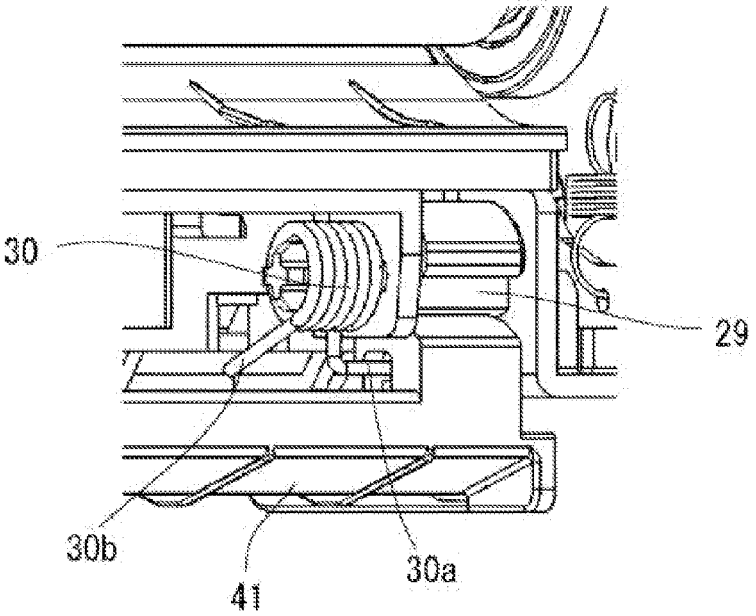
FIG. 5B illustrates an enlarged view of a periphery of a first axle.
Figure 5C:
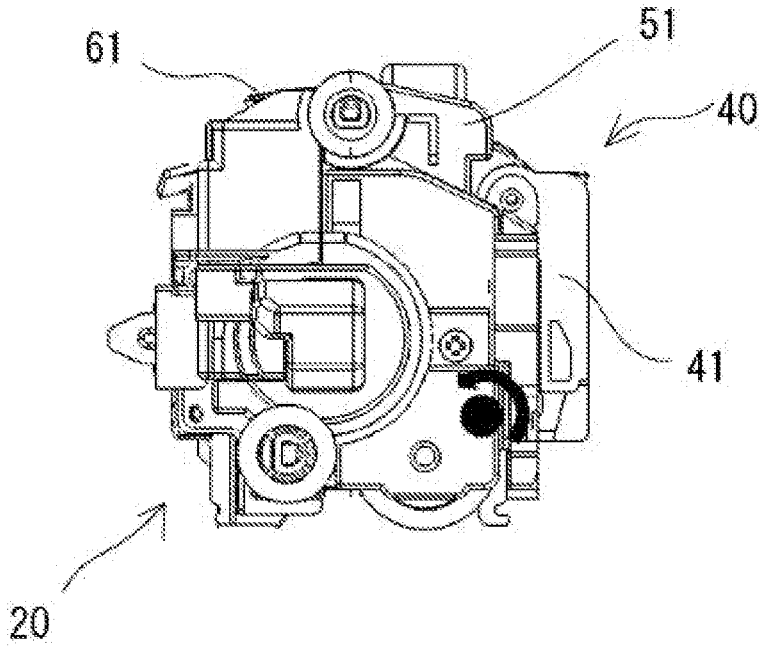
FIG. 5C illustrates a load acting on the first axle.

In the fixing device main body 20, a load generating portion, which generates a load returning the fixing cover 40 in the open state to the closed state, is located. The load generating portion is constituted of a coil spring 30, as illustrated in FIGS. 5A and 5B. One end 30*b* of the coil spring 30 is secured to a member constituting the fixing device main body 20 and another end 30*a* of the coil spring 30 is secured to the fixing cover 40 (accurately, a first fixing cover 41). When the fixing cover 40 is rotated around the first axle 29 in order to be the open state, as illustrated by an arrow in FIG. 5C, a torsional load, which causes the fixing cover 40 (accurately the first fixing cover portion 41) to return to the closed state, occurs by the coil spring 30.

(3) Fixing Cover

Figure 6A:
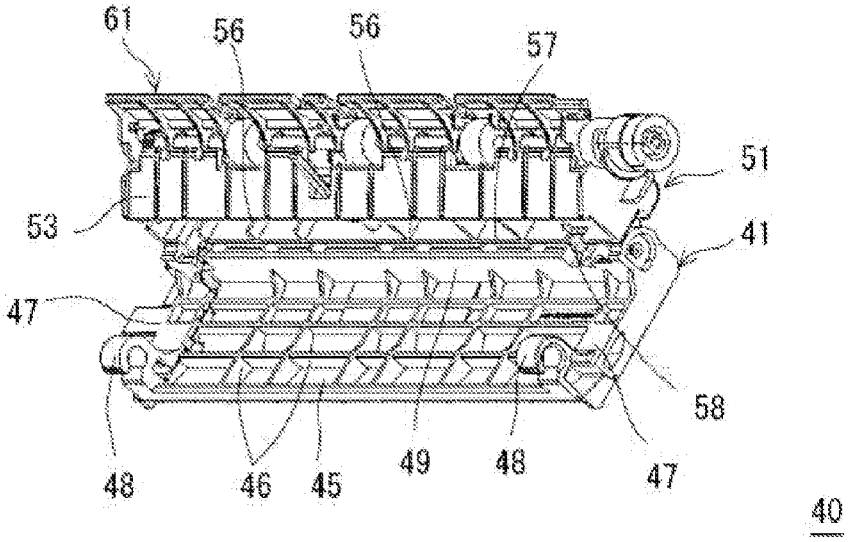
FIG. 6A perspectively illustrates a fixing cover according to the one embodiment.
Figure 6B:
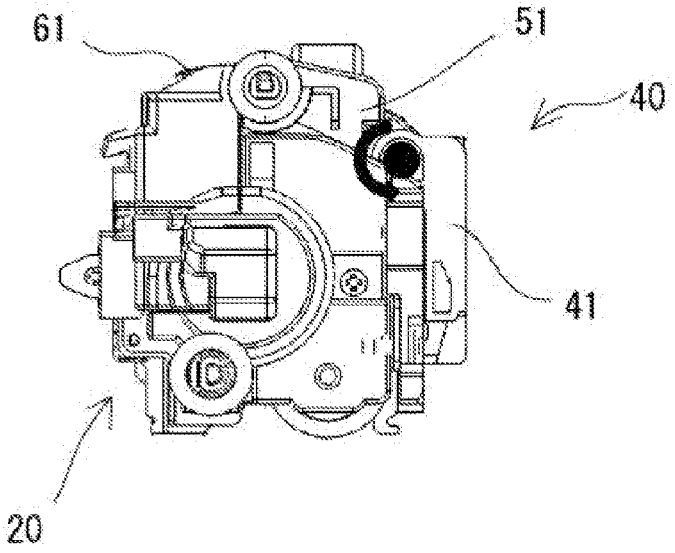
FIG. 6B illustrates a load acting on a first fixing cover and a second fixing cover according to the one embodiment.

As described above, the fixing cover 40 has the first fixing cover portion 41 and the second fixing cover portion 51. Here, the first fixing cover portion 41 and the second fixing cover portion 51 are different members: the first fixing cover portion 41 is constituted of the first fixing cover; and the second fixing cover portion 51 is constituted of the second fixing cover, respectively. Define that reference numeral of the first fixing cover is also "41," and reference numeral of the second fixing cover is also "51." As illustrated in FIGS. 6A and 6B, the first fixing cover 41 has a plate-shaped portion 45, a rib portion 46, a thick portion 47, an engaging portion 48, and a second axle holding portion 49. The plate-shaped portion 45 mainly covers a back surface of the opening 21 and has a rectangular shape long in the axial direction. The rib portion 46 reinforces the plate-shaped portion 45. Here, the rib portion 46 is located in an inner surface (a facing surface to the heat roller 11) of the plate-shaped portion 45 such that the rib portion 46 extends in two directions: an axial direction of the heat roller 11 and a direction perpendicular to the axial direction of the heat roller 11. The thick portion 47 has thickness which is thicker than the thickness of the plate-shaped portion 45 and is approximately equal to a rib height of the rib portion 46. The thick portions 47 are located in both ends in a longitudinal direction of the plate-shaped portion 45.

The engaging portions 48 engage with the first axle 29 of the fixing device main body 20. The engaging portions 48 are formed in lower end portions of the thick portions 47 and have hooked-shapes. This ensures removable installation of the fixing cover 40 with respect to the fixing device main body 20. The second axle holding portion 49 holds a second axle 52. The second axle holding portion 49 projects from an inner surface in an upper end portion of the plate-shaped portion 45 to a thickness direction of the plate-shaped portion 45 and houses the second axle 52 inside the second axle holding portion 49. The second fixing cover 51 mainly covers a most part of a top surface of the opening 21. The second fixing cover 51 is rotatably mounted to the first fixing cover 41 with the second axle 52 as the rotational central axle. That is, the first fixing cover 41 and the second fixing cover 51 are rotatably combined via the second axle 52, and thus have a bendable structure. When the first fixing cover 41 rotates around the first axle 29 such that an upper end portion of the first fixing cover 41 moves away from the opening 21, the second fixing cover 51 rotates around the second axle 52 such that the forward end portion of the second fixing cover 51 moves down. The second axle 52 is held onto the first fixing cover 41 (the second axle holding portion 49 of the first fixing cover 41) in a state that the second axle 52 extends in the axial direction of the heat roller 11.

Figure 7A:
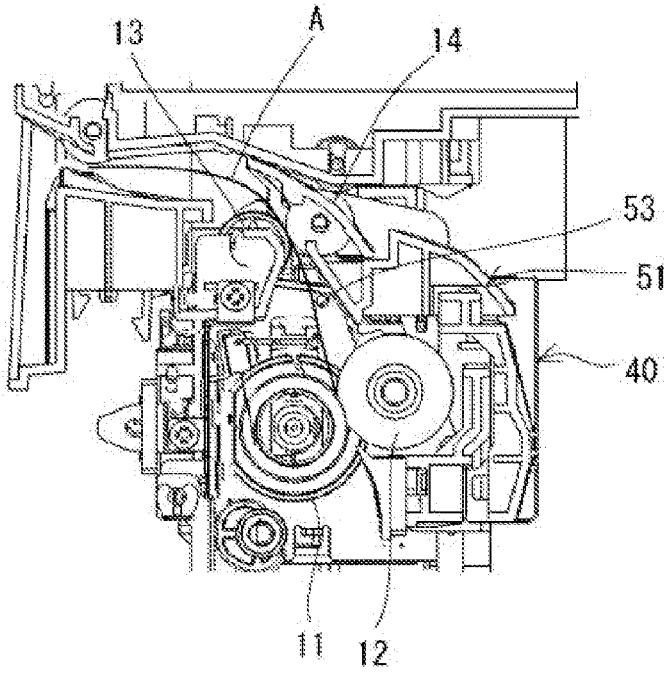
FIG. 7A illustrates a path which a recording sheet passes through during fixing.
Figure 7B:
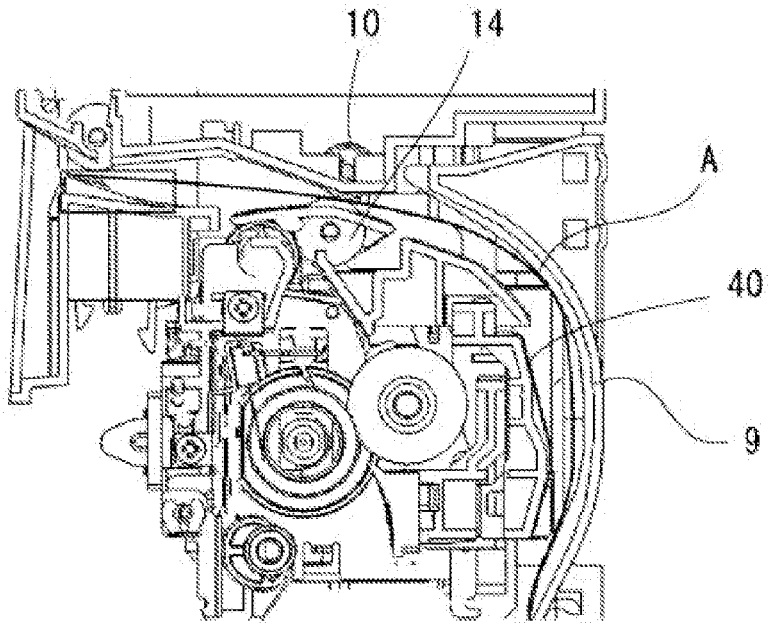
FIG. 7B illustrates a path which the recording sheet passes through during front-and-back inversion of the recording sheet.

The second fixing cover 51 includes an after-fixing guiding portion 53, an inversion guiding portion 54, a connecting portion 55, a front-rear rib portion 56, and a vertical rib portion 57. The after-fixing guiding portion 53, as illustrated in FIG. 7A, has a function of guiding a recording sheet A, which has undergone fixing and passed between the heat roller 11 and the press roller 12, between the discharge rollers 13 and 14. The after-fixing guiding portion 53, as illustrated in FIG. 2 and FIGS. 7A and 7B, is located on the upper side of the heat roller 11 and the press roller 12. The inversion guiding portion 54, as illustrated in FIG. 7B, has a function of guiding the recording sheet A to return to the image forming unit 2 when an image is formed on the back of the recording sheet A. The recording sheet A returning to the image forming unit 2 passes the inverting conveyance path 8 constituted of the inversion guiding portion 54 and a back surface cover 9 of the image forming apparatus 1. The connecting portion 55, as illustrated in FIG. 2 and FIGS. 7A and 7B, connects the after-fixing guiding portion 53 and the inversion guiding portion 54. A lateral cross-section (a cross-section perpendicular to the axial direction) of a portion, which extends from the after-fixing guiding portion 53 to the inversion guiding portion 54 via the connecting portion 55, is "N"-shaped.

The front-rear rib portion 56 has a function of reinforcing the inversion guiding portion 54 and the connecting portion 55. The front-rear rib portion 56 extends in a direction perpendicular to the axial direction across the inversion guiding portion 54 and the connecting portion 55. A plurality of front-rear rib portions 56 are arranged at intervals in the axial direction. The front-rear rib portion 56 has a through-hole through which the second axle 52 is inserted, and thus the second fixing cover 51 is mounted to the first fixing cover 41 via the second axle 52. The vertical rib portion 57 is formed across the front-rear rib portions 56 which are neighboring with one another in the axial direction and extends in the vertical direction. Between the vertical rib portion 57 and the inversion guiding portion 54, as illustrated in FIG. 2, is formed a space where the second axle holding portion 49 of the first fixing cover 41 enters. This ensures regulation of rotation of the second fixing cover 51 by abutting contact between the vertical rib portion 57 and the second axle holding portion 49 when the fixing cover 40 rotates around the first axle 29, and the first fixing cover 41 and the second fixing cover 51 approach each other.

A load generating portion, which generates a load to bring the first fixing cover 41 and the second fixing cover 51 closer when the fixing cover 40 is in the open state, is located in the first fixing cover 41 and the second fixing cover 51. The load generating portion is, as illustrated in FIG. 6A, constituted of a tension spring 58. The tension spring 58 is located with one end secured in the first fixing cover 41 and the other end secured in the second fixing cover 51, respectively. When the fixing cover 40 rotates around the first axle 29 to be the open state, as illustrated by an arrow in FIG. 6B, a tensile load, which brings the first fixing cover 41 and the second fixing cover 51 closer, occurs by the tension spring 58. The fixing cover 40 has a conveyance guide 61 in addition to the above-described first fixing cover 41 and second fixing cover 51. The conveyance guide 61 is provided with a third axle 62, extending in the axial direction of the first axle 29 and the second axle 52, on which, as its rotational center axis, the guide 61 is free to rotate.

Figure 8A:
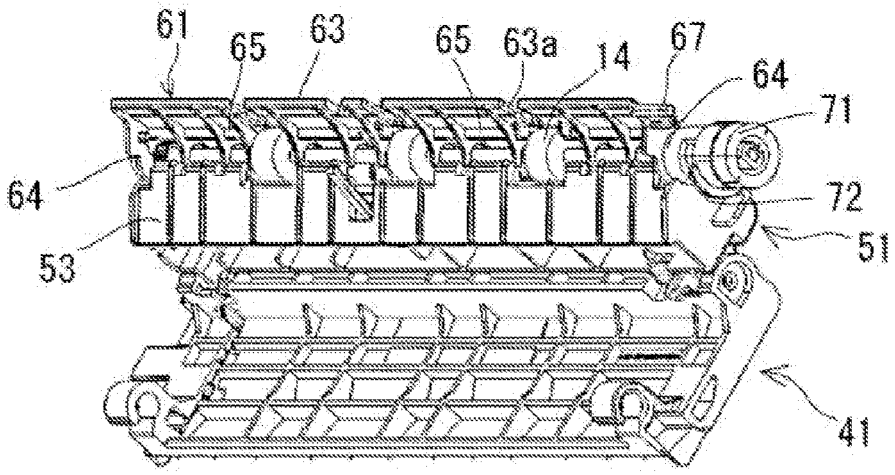
FIG. 8A perspectively illustrates the fixing cover according to the one embodiment.
Figure 8B:
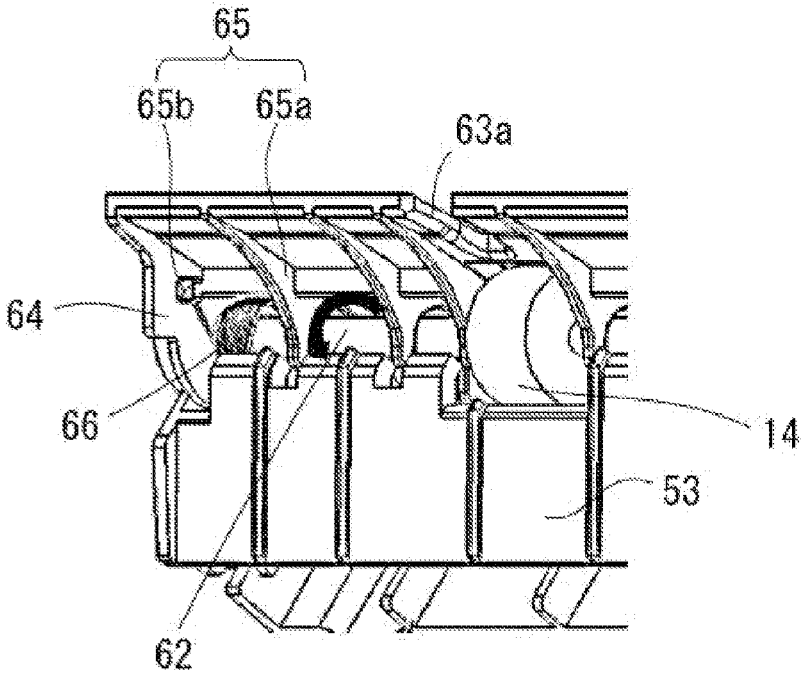
FIG. 8B illustrates an enlarged view of a periphery of a third axle.

The third axle 62 is located corresponding to an end portion position (a front end portion position on an upper side) on a downstream side of the traveling direction of the recording sheet in the opening 21, in a state where the fixing cover 40 covers the opening 21. The third axle 62 is mounted on a third axle mounting portion, which is in an end portion (a forward end portion) on an opposite side with respect to a side where the first fixing cover 41 is positioned, in the second fixing cover 51. The conveyance guide 61 has a plate-shaped portion 63, an upright provided portion 64, and a rib portion 65. The plate-shaped portion 63 has a rectangular plate shape, long in an axial direction of the third axle 62. The plate-shaped portion 63 has a cutout 63*a* in a position corresponding to the discharge roller 13, as illustrated in FIG. 8B. The upright provided portion 64 extends from an inner surface (a surface on a side facing to the heat roller 11) of an end in a longitudinal direction (the axial direction of the third axle 62) of the plate-shaped portion 63 to the inside, in a plate shape. The upright provided portion 64 has a through-hole through which the third axle 62 is inserted. That is, the upright provided portion 64 is a mounting portion for mounting the conveyance guide 61 onto the third axle 62.

The rib portion 65 is formed in an inner surface of the plate-shaped portion 63. The rib portion 65 includes a lateral rib portion 65*a* extending in a lateral direction of the plate-shaped portion 63 and a longitudinal rib portion 65*b* extending in a longitudinal direction of the plate-shaped portion 63. As illustrated in FIGS. 8A and 8B, the lateral rib portion 65*a* has a cutout in a portion where the third axle 62 passes. When the conveyance guide 61 rotates around the third axle 62 by some degree, an end portion in a height direction in the lateral rib portion 65*a* is brought in contact with the second fixing cover 51 and becomes a regulating portion regulating rotation of the conveyance guide 61. In the fixing cover 40, there is located a load generating portion generating a load, which moves down a forward end portion of the conveyance guide 61 when the first fixing cover 41 rotates to be in the open state. As illustrated in FIG. 8B, the load generating portion is, for example, constituted of a coil spring 66. The coil spring 66 is located with one end secured to the second fixing cover 51 and the other end secured to the conveyance guide 61.

Figure 8C:
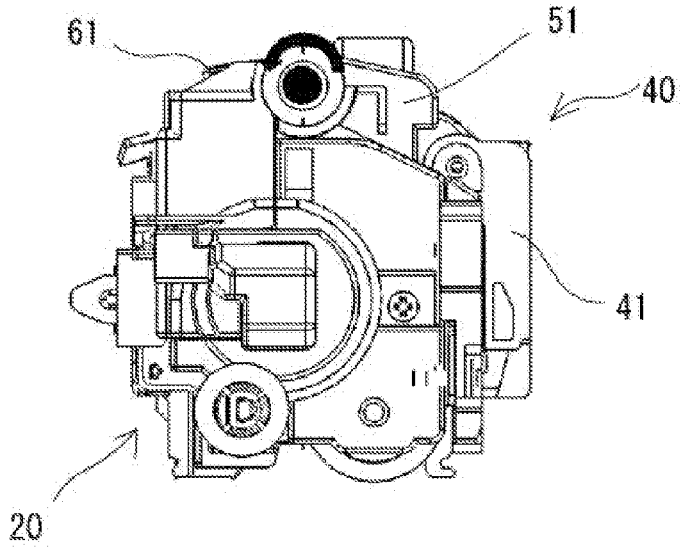
FIG. 8C illustrates a load acting on the third axle.
Figure 9A:
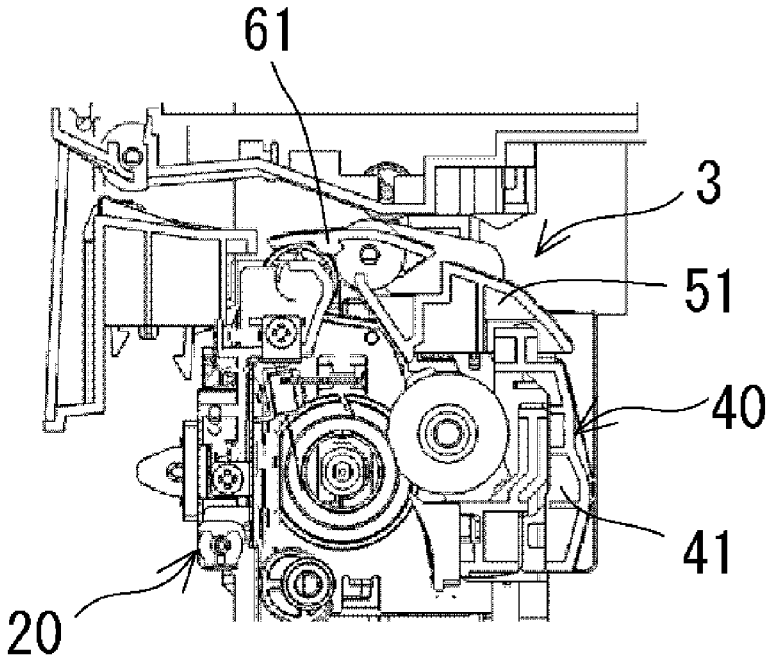
FIGS. 9A to 9G illustrate a state where the fixing cover according to the one embodiment rotates around the first axle.
Figure 9B:
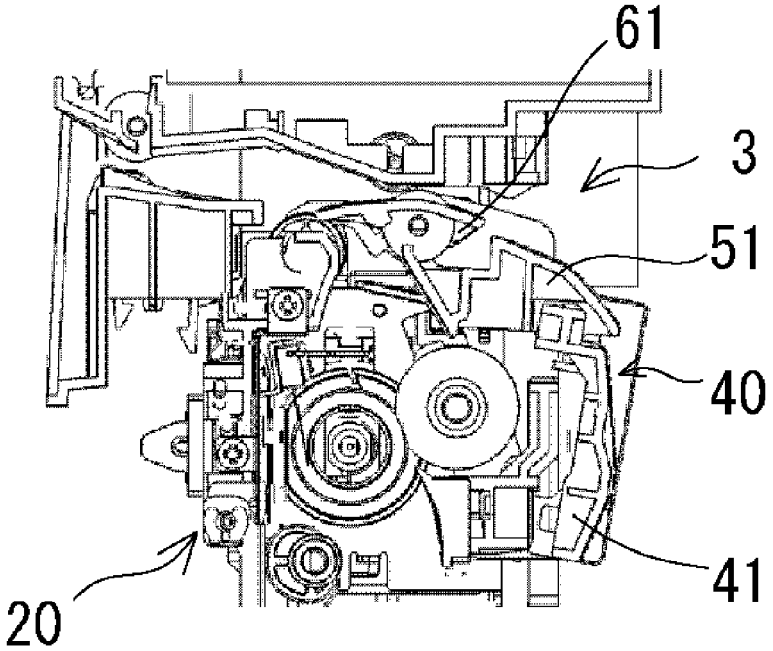
Figure 9C:
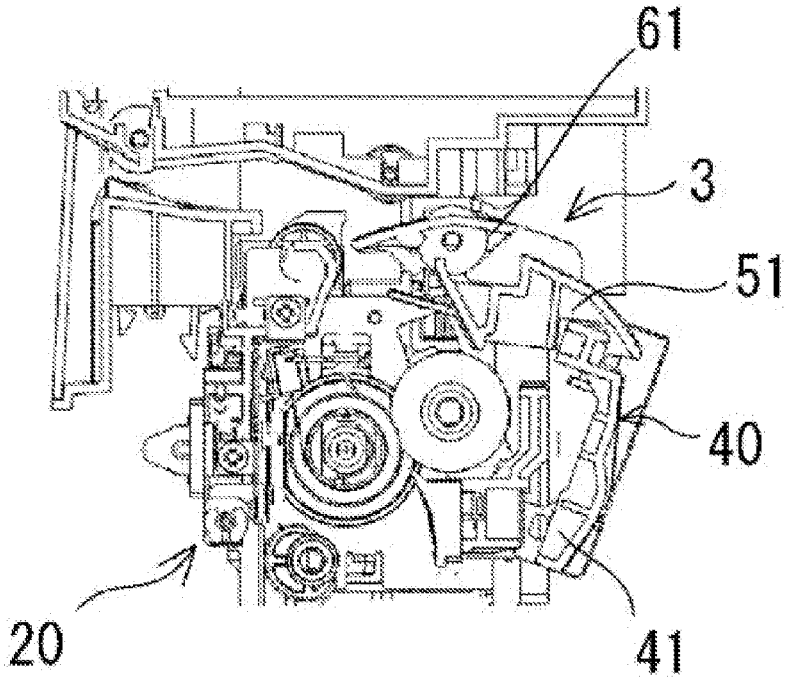
Figure 9D:
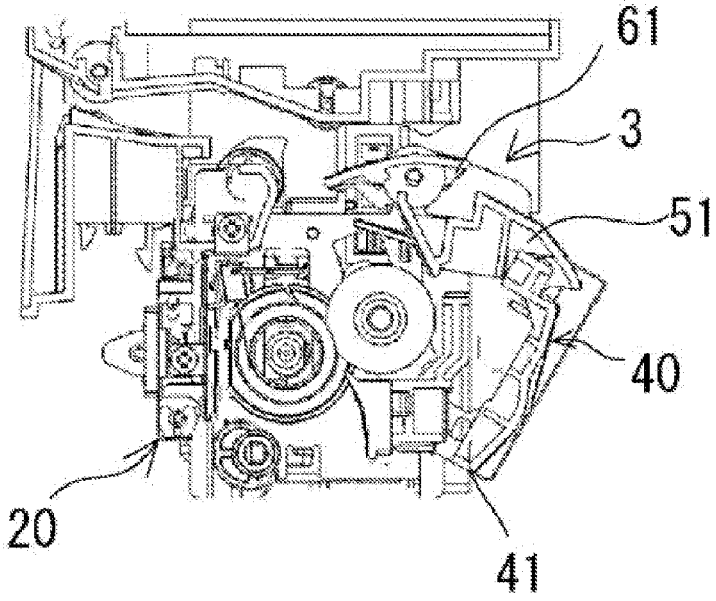
Figure 9E:
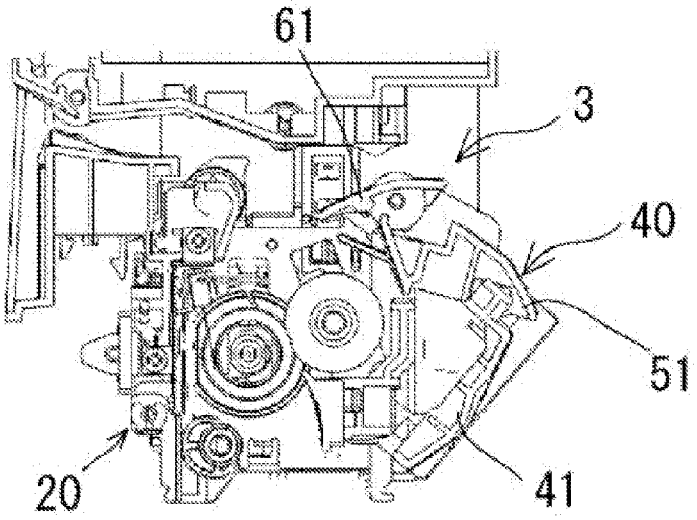
Figure 9F:
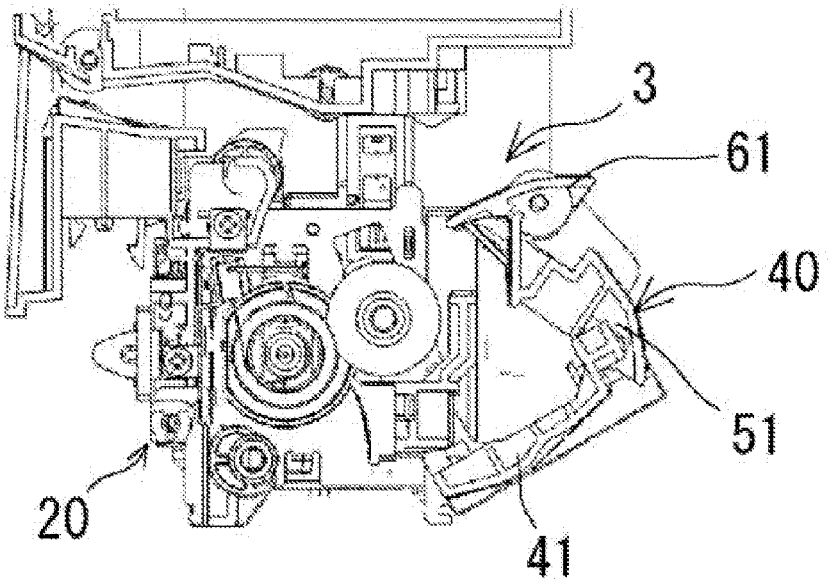
Figure 9G:
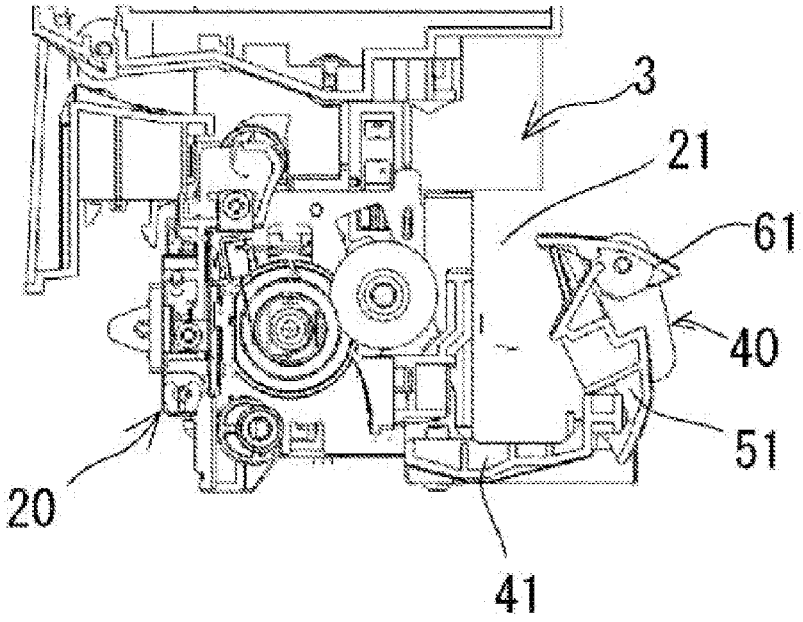

When the fixing cover 40 rotates around the first axle 29 to be the open state, as illustrated by an arrow in FIG. 8C, a torsional load, which causes the forward end portion of the conveyance guide 61 to move down, occurs by the coil spring 66. Discharge rollers 14 are plurally provided running along the third axle 62. These discharge rollers 14 abut on (become paired with) the discharge rollers 13 in the upper housing 25 of the fixing device main body 20. The third axle 62 is longer than the axial length of the third axle 62 in the second fixing cover 51, and one end portion of the third axle 62 projects out of the second fixing cover 51. In the one end portion of the third axle 62 is located a drive input unit 71 where drive for rotation of the third axle 62 is inputted. An abutment 72 that abuts on the support region 28 in the top surface of the side cover 26 is furnished on the one end portion of the third axle 62. The inferior surface of the contact portion 72 is arcuate. It should thus be understood that the abutment 72 is provided on an inferior surface of the drive input unit 71.

The top surface (the support region 28) of the side cover 26, with which the contact portion 72 is brought in contact, is a contact portion support region 73. The contact portion support region 73 is located along the traveling direction of the recording sheet. The contact portion support region 73 is constituted of a horizontal flat region, which is located in a portion where the contact portion 72 is positioned in the closed state of the fixing cover 40, and an inclined region, which descends in accordance with travel to the upstream side from an end portion on the upstream side in the traveling direction of the recording sheet in the flat region. The conveyance guide 61 has an extending portion 67 extending outward in the axial direction of the third axle 62. The extending portion 67 is bar-shaped with a circular-shaped cross section.

The support region 28, with which the extending portion 67 is brought in contact, in the top surface of the side cover 26 is an extending portion support region 74. The extending portion support region 74 is located along the travelling direction of the recording sheet. The extending portion support region 74 is inclined to descend in accordance with travel to the upstream side from a position where the extending portion 67 is present, in the closed state of the fixing cover 40. The extending portion support region 74 has a concave portion 75 with a "V" shape, when viewed from the extending direction, in a portion where the extending portion 67 is positioned in the closed state. In the third axle 62, as illustrated in FIGS. 7A and 7B, a posture change portion, which causes a posture of the conveyance guide 61 to be changed at front-and-back inversion of the recording sheet during fixing, is provided.

3. Operations

The following describes operations to make the fixing cover 40 to be in the open state when JAM occurs inside the fixing device 3 and a recording sheet is removed, with use of FIGS. 9A to 16B. First, as illustrated in FIGS. 9A to 9G, when dealing with JAM, the opening 21 is opened by rotation of the fixing cover 40 with the first axle 29 as the rotational central axle. In FIGS. 9A to 9G, FIG. 9A illustrates the state where the fixing cover 40 is not rotated with respect to the fixing device main body 20, and FIG. 9G illustrates the state where the fixing cover 40 is rotated by 90 degrees with respect to the fixing device main body 20. FIG. 9B illustrates the state of rotation of the fixing cover 40 by 10 degrees, FIG. 9C by 20 degrees, FIG. 9D by 30 degrees, FIG. 9E by 40 degrees, and FIG. 9F by 60 degrees, respectively.

Figure 10A:
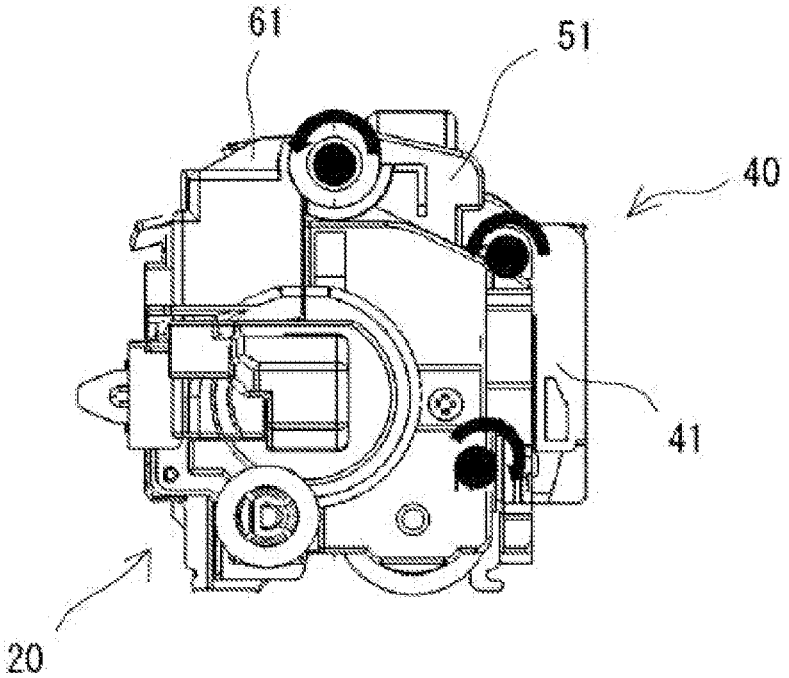
FIG. 10A illustrates a side surface of the fixing device according to the one embodiment.
Figure 10B:
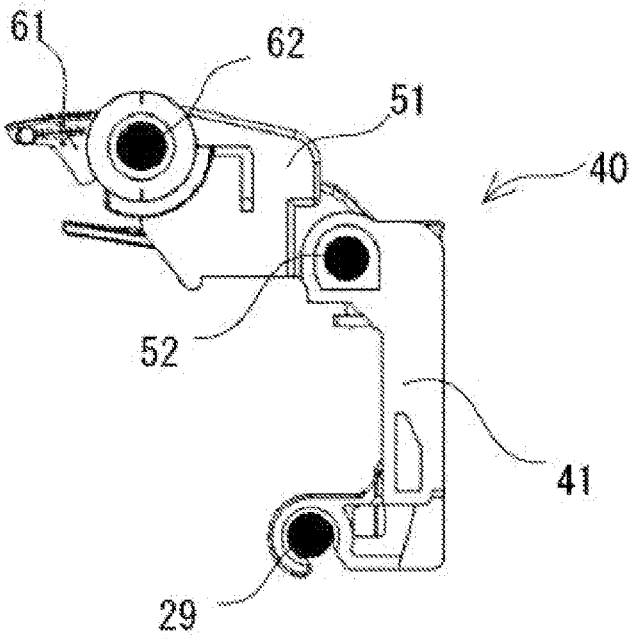
FIG. 10B illustrates a side surface of the fixing cover according to the one embodiment.
Figure 10C:
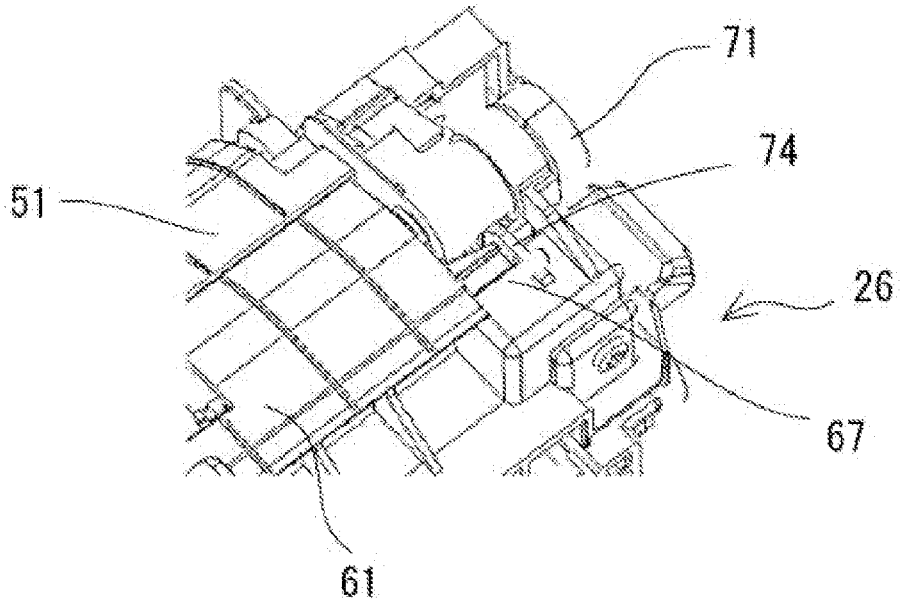
FIG. 10C illustrates the fixing device according to the one embodiment from diagonally upward.
Figure 11A:
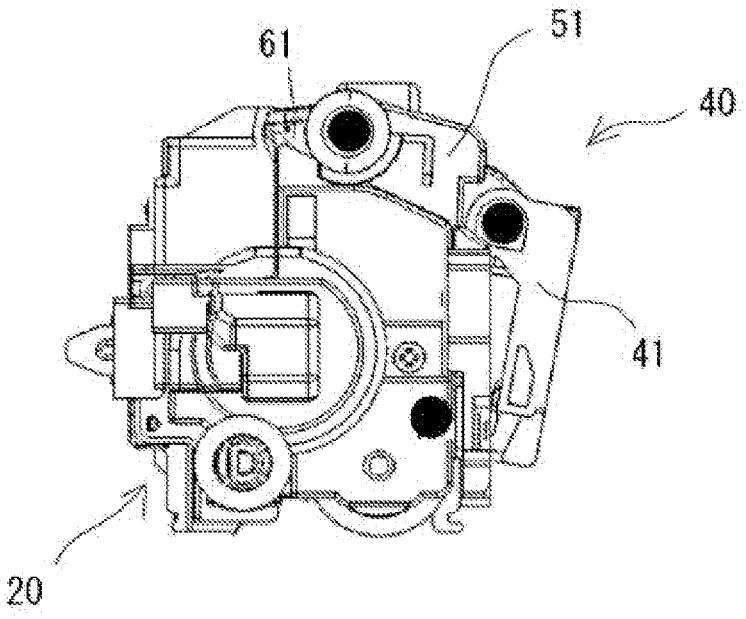
FIG. 11A illustrates the side surface of the fixing device according to the one embodiment.
Figure 11B:
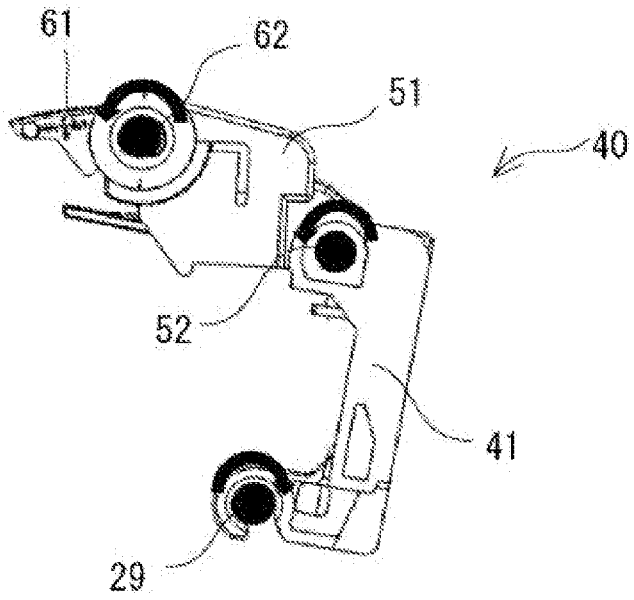
FIG. 11B illustrates the side surface of the fixing cover according to the one embodiment.
Figure 11C:
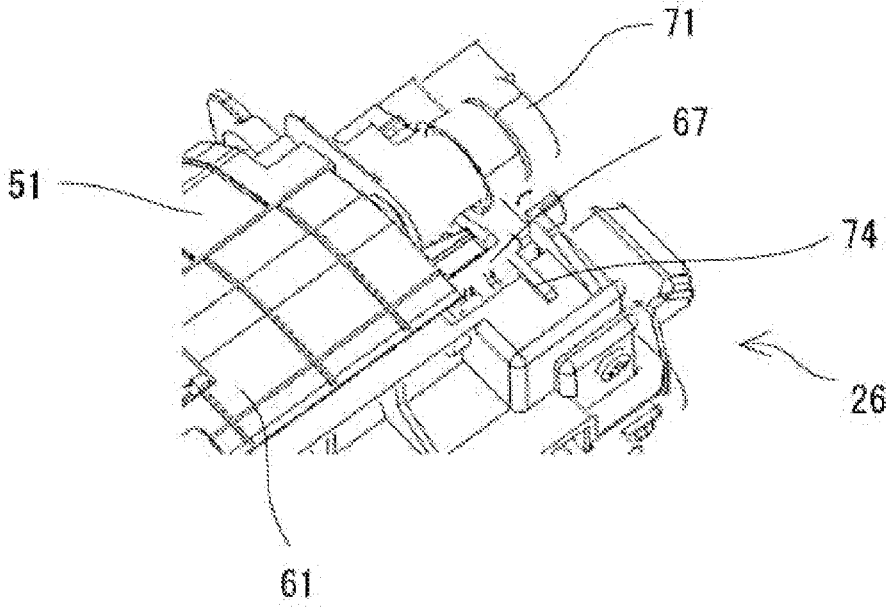
FIG. 11C illustrates the fixing device according to the one embodiment from diagonally upward.
Figure 12A:
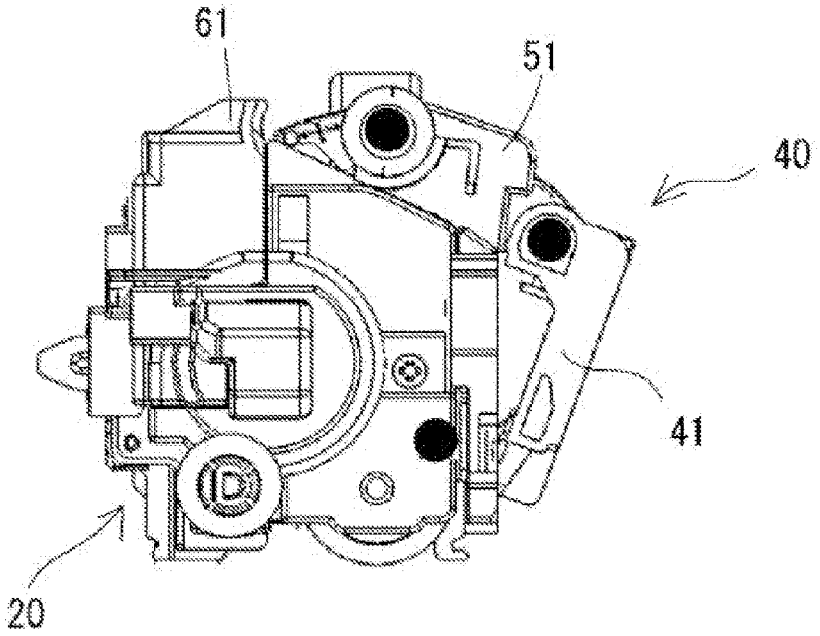
FIG. 12A illustrates the side surface of the fixing device according to the one embodiment.
Figure 12B:
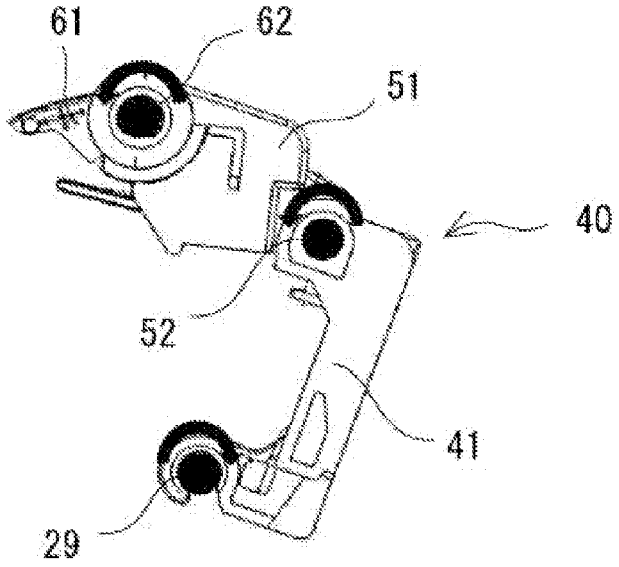
FIG. 12B illustrates the side surface of the fixing cover according to the one embodiment.
Figure 12C:
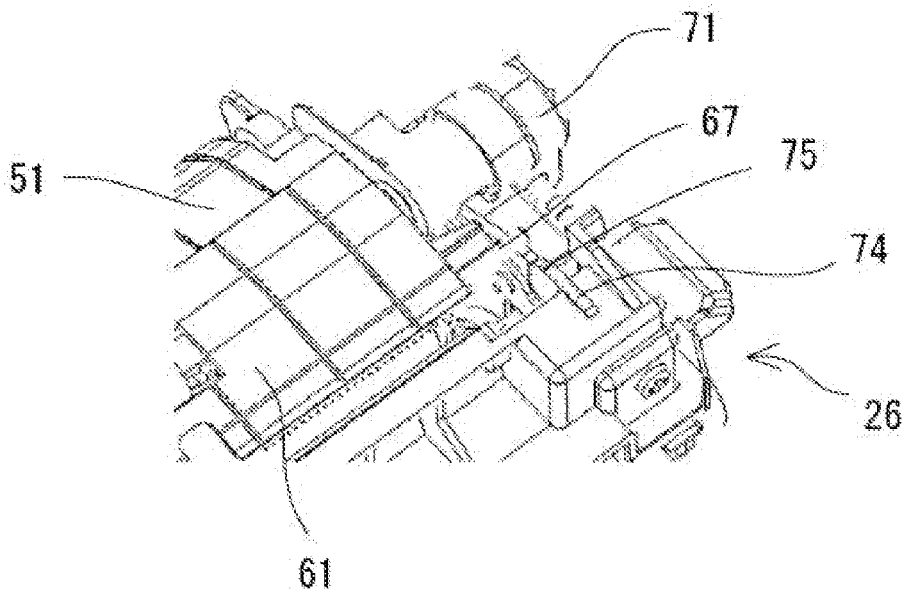
FIG. 12C illustrates the fixing device according to the one embodiment from diagonally upward.
Figure 13A:
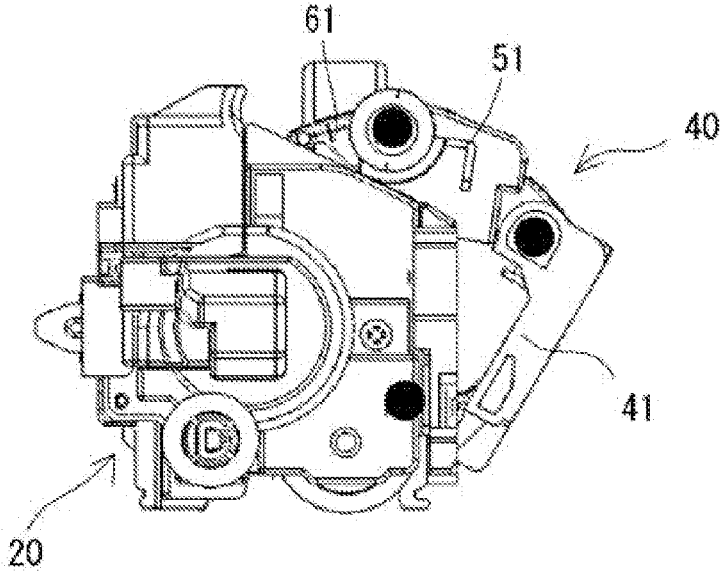
FIG. 13A illustrates the side surface of the fixing device according to the one embodiment.
Figure 13B:
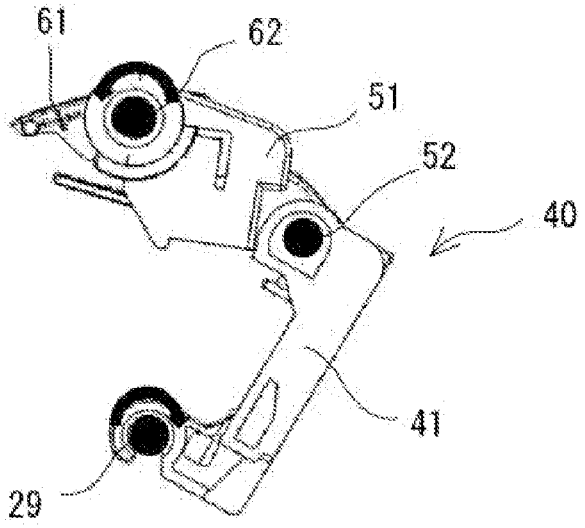
FIG. 13B illustrates the side surface of the fixing cover according to the one embodiment.
Figure 13C:
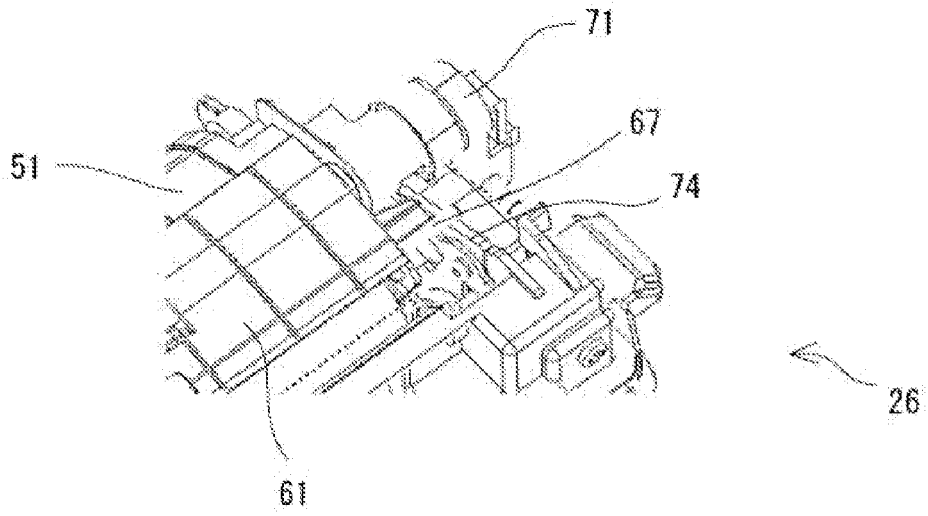
FIG. 13C illustrates the fixing device according to the one embodiment from diagonally upward.
Figure 14A:
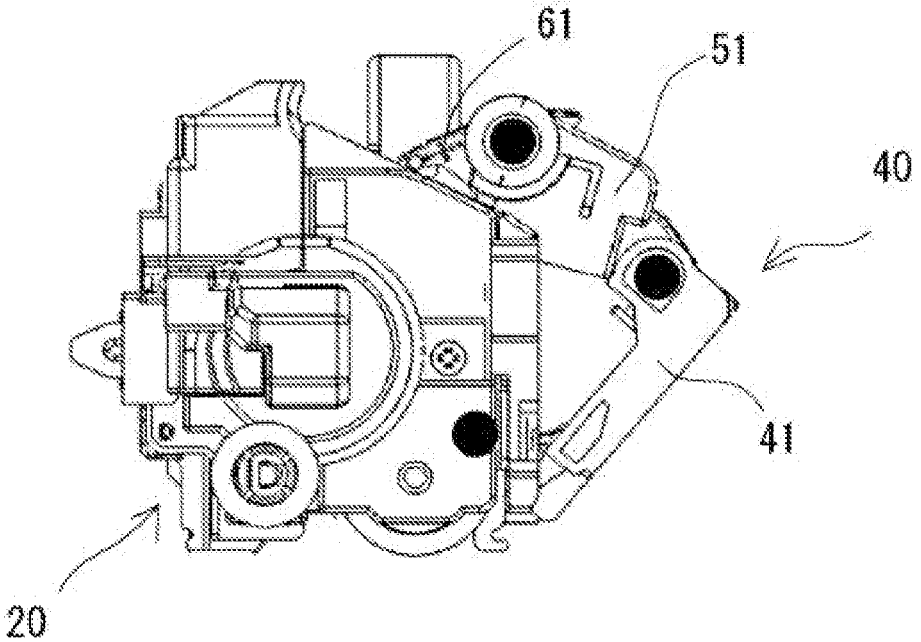
FIG. 14A illustrates the side surface of the fixing device according to the one embodiment.
Figure 14B:
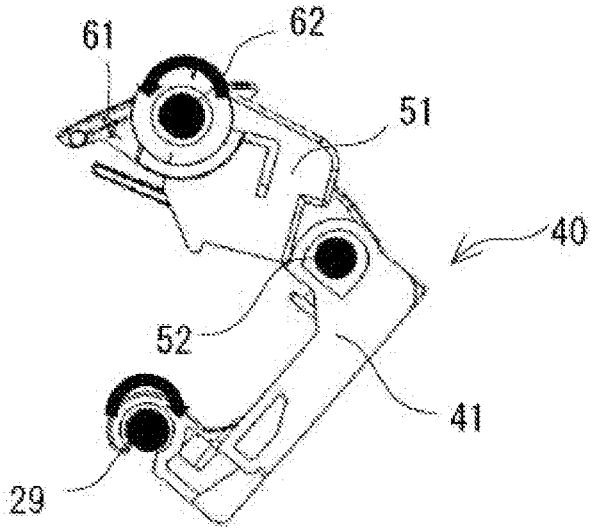
FIG. 14B illustrates the side surface of the fixing cover according to the one embodiment.
Figure 14C:
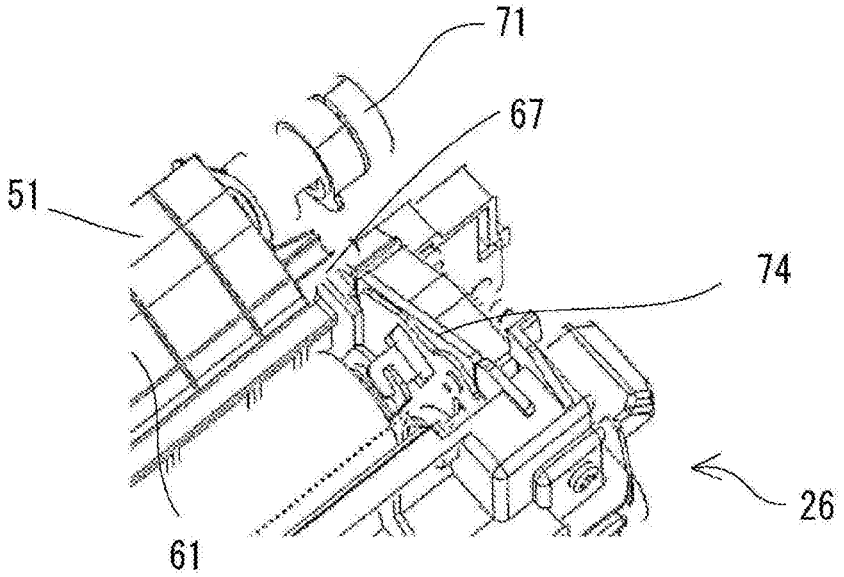
FIG. 14C illustrates the fixing device according to the one embodiment from diagonally upward.
Figure 15A:
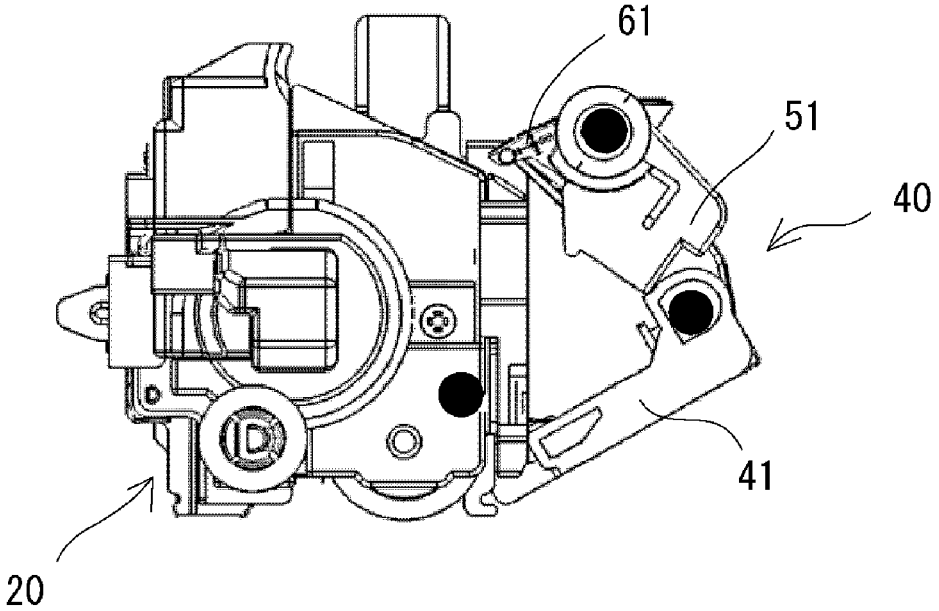
FIG. 15A illustrates the side surface of the fixing device according to the one embodiment.
Figure 15B:
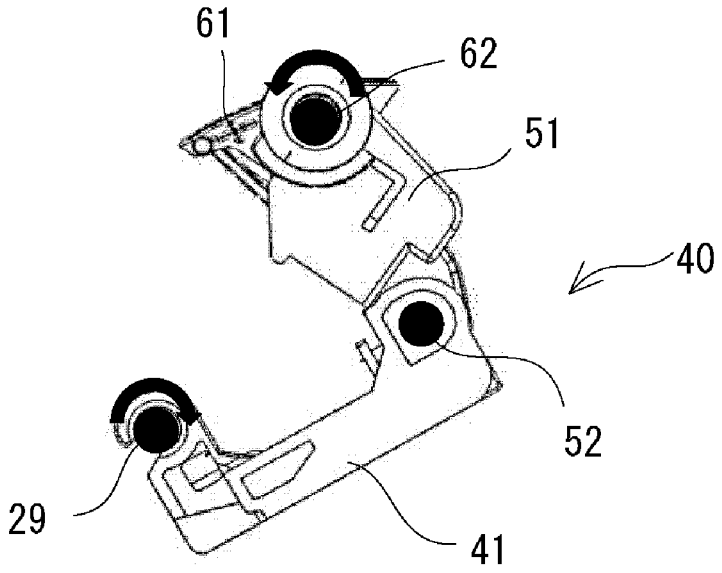
FIG. 15B illustrates the side surface of the fixing cover according to the one embodiment.
Figure 15C:
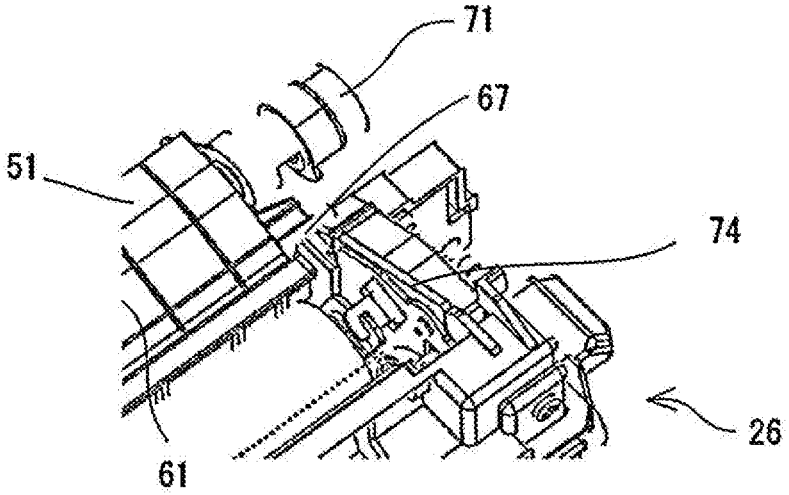
FIG. 15C illustrates the fixing device according to the one embodiment from diagonally upward.
Figure 16A:
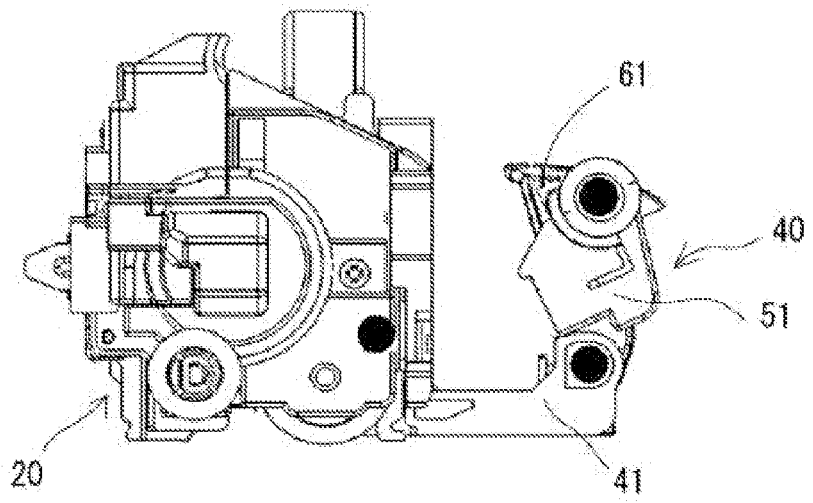
FIG. 16A illustrates the side surface of the fixing device according to the one embodiment.
Figure 16B:
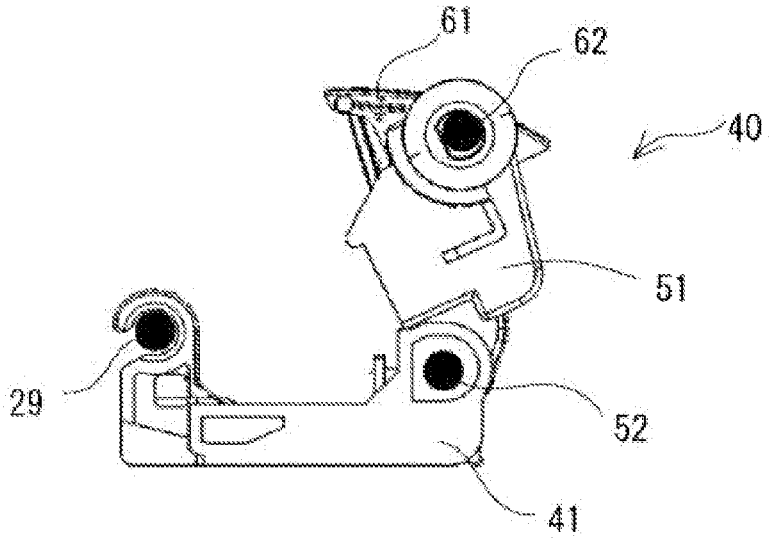
FIG. 16B illustrates the side surface of the fixing cover according to the one embodiment.

Each A in FIGS. 10A to 16B illustrates a side surface of the fixing device, each B illustrates a side surface of the fixing covers, and each C of FIGS. 10A to 15C illustrates the fixing device from diagonally upward. FIGS. 10A to 10C are the states where the fixing cover 40 is not rotated with respect to the fixing device main body 20. FIGS. 16A and 16B are the states where the fixing cover 40 is rotated by 90 degrees with respect to the fixing device main body 20, and there is no drawing of the fixing device viewed from diagonally upward. FIGS. 11A to 11C illustrate the state of rotation of the fixing cover 40 by 10 degrees, FIGS. 12A to 12C by 20 degrees, FIGS. 13A to 13C by 30 degrees, FIGS. 14A to 14C by 40 degrees, and FIGS. 15A to 15C by 60 degrees, respectively. That is, the rotation angles of FIGS. 10A to 16B correspond to the rotation angles of FIGS. 9A to 9G.

When rotating the fixing cover 40, the first fixing cover 41 is rotated around the first axle 29 from the back surface side of the fixing device 3. In this case, as illustrated in FIGS. 9B to 9D and FIG. 11A to FIG. 16B, the second fixing cover 51 rotates about the second axle 52 as the rotational central axle such that the forward end portion (the downstream end of the after-fixing guiding portion 53) of the second fixing cover 51 moves down in association with rotation of the first fixing cover 41. That is, the second fixing cover 51 bends with respect to the first fixing cover 41 such that a gap between the first fixing cover 41 and the second fixing cover 51 narrows. This ensures that the forward end portion of the second fixing cover 51 draws a movement track without rising from the position in the closed state. That is, this eliminates a need for a space for rotation of the second fixing cover 51. Furthermore, the conveyance guide 61 rotates about the third axle 62 as the rotational central axle in association with rotation of the first fixing cover 41 such that the conveyance guide 61 moves down. This ensures that the conveyance guide 61 draws a movement track without rising from the position in the closed state. That is, this eliminates a need for a space for rotation of the conveyance guide 61

In the fixing device 3 with the structure described above, the fixing cover 40 does not rise from the position in the open state when rotating the fixing cover 40 for transition from the closed state to the open state. Therefore, in the inside of the image forming apparatus 1 with the fixing device 3 internally incorporated, as illustrated in FIGS. 9A to 9G, it is sufficient to allocate only the space for housing the fixing device 3, and this ensures downsizing of the image forming apparatus 1.

4. Others (1) The second fixing cover 51 is rotatably located with the second axle 52 as the rotational central axle. This easily ensures embodiment of the fixing device 3 where an opening/closing space of the fixing cover 40, which opens and closes the opening 21, is smaller.

(2) The fixing cover 40 has the third axle 62, which extends in the width direction of the passing recording sheet, in the end portion on the opposite side with respect to the first fixing cover 41 in the second fixing cover 51. This can facilitate locating the conveyance guide 61 in the second fixing cover 51.

(3) The third axle 62 is located corresponding to the end portion position on the downstream side of the travelling direction of the recording sheet in the opening 21, in the state where the fixing cover 40 covers the opening 21. This ensures installation of the discharge roller 14 onto the third axle 62.

(4) The third axle 62 is located in the second fixing cover 51, and in the conveyance guide 61, an intermediate portion in the conveyance direction of the recording sheet is rotatably mounted onto the third axle 62. This can facilitate a change of posture of the conveyance guide 61. Accordingly, this ensures discharge of the recording sheet after fixing and the front-and-back inversion of the recording sheet with a simple structure.

(5) The second fixing cover 51 is supported by the support region 28 in the top surface of the side cover 26. This can prevent the second fixing cover 51 from entering inside the opening 21.

(6) The end portion of the third axle 62 projects out of one end in the axial direction of the second fixing cover 51 and has the drive input unit 71 for driving the third axle 62. The contact portion 72, which is brought in contact with the top surface (the support region 28) of the side cover 26, is located in the inferior surface of the drive input unit 71. This arrangement of the contact portion 72 with use of the drive input unit 71 ensures implementation with low-price.

(7) The inferior surface of the contact portion 72 is arc-shaped. This can facilitate movement of the contact portion 72 on the support region 28 (the contact portion support region 73).

(8) The contact portion support region 73 in the top surface of the side cover 26 is located along the travelling direction of the recording sheet, and the first axle 29, the second axle 52, and the third axle 62 are perpendicular to the travelling direction of the recording sheet. This ensures that the contact portion support region 73 supports the contact portion 72 over a wide range.

(9) The second fixing cover 51 approaches (moves down to) the first fixing cover 41 by the tension spring 58 as the load generating portion, in association with rotation of the first fixing cover 41 to the open state. At this time, because the second fixing cover 51 is supported by the contact portion support region 73 via the contact portion 72, the second fixing cover 51 can move along the contact portion support region 73.

(10) The contact portion support region 73 is constituted of the horizontal flat region, which is located in the portion where the contact portion 72 is positioned in the closed state of the opening 21 by the fixing cover 40, and the inclined region, which is located in the state where the inclined region descends in accordance with travel to the upstream side from the end portion on the upstream side in the traveling direction of the recording sheet in the flat region. This ensures that the second fixing cover 51 moves downward without rising from the position in the closed state, in association with rotation of the first fixing cover 41 to the open state.

(11) The conveyance guide 61 has the extending portion 67, which extends outward in the width direction from the end portion in the width direction of the traveling recording sheet, and the extending portion 67 is supported by the support region 28 (the extending portion support region 74) in the top surface of the side cover 26. This can prevent the conveyance guide 61 from entering the inside of the opening 21.

(12) The extending portion support region 74 of the side cover 26 is located along the travelling direction of the recording sheet, and the first axle 29, the second axle 52, and the third axle 62 are perpendicular to the travelling direction of the recording sheet. This ensures that the extending portion support region 74 supports the extending portion 67 over a wide range.

(13) The conveyance guide 61 approaches (moves down to) the second fixing cover 51 by the coil spring 66 as the load generating portion, in association with rotation of the first fixing cover 41 to the open state. At this time, because the conveyance guide 61 is supported by the extending portion support region 74 via the extending portion 67, the conveyance guide 61 can move along the extending portion support region 74.

(14) The extending portion support region 74 is inclined to descend in accordance with travel to the upstream side from the position where the extending portion 67 is present, in the closed state of the opening 21 by the fixing cover 40. This ensures that the conveyance guide 61 moves downward without rising from the position in the closed state, in association with rotation of the first fixing cover 41 to the open state.

(15) The extending portion support region 74 has the concave portion 75 with the "V" shape, when viewed from the extending direction, in the portion where the extending portion 67 is positioned, in the closed state of the opening 21 by the fixing cover 40. This can hold the position of the fixing cover 40 in the closed state.

(16) The discharge roller 14 located in the conveyance guide 61 can double as a switchback roller together with a roller 10 of a switchback mechanism. This ensures a structure performing backside printing with less-price. In view of this, the fixing device 3 is also applicable to an image forming apparatus capable of duplex printing.

Modification

Although the fixing device and the image forming apparatus according to the embodiment have been described above, the disclosure is not limited to the embodiment described above, and for example, the following modification may be applicable. The embodiment and the modification may be combined, or the modifications may be combined together. The disclosure includes an example, which is not described in the embodiment and a modification, and a design change in a scope, which does not depart from the gist.

1. Image Forming Apparatus

The image forming apparatus can be applied to, for example, a copier, a facsimile, a printer and a similar device, and can be applied to a multi-functional peripheral provided with these functions together. Image formation was described as full color with tandem type, and may be monochrome.

2. Fixing Device

A structure of the fixing device is sufficient as long as the structure can endure heat and pressure and has an opening across a back surface and a top surface, and a holding method and a driving method of a heat roller and a press roller are not especially limited. For example, a heat roller and a press roller may be hold by a housing with an opening in a top surface and a back surface. Although the back surface of the fixing device constitutes the inverting conveyance path, even a fixing device incorporated in an image forming apparatus of a single-side printing type may be applicable.

3. Fixing Cover

In the embodiment, although the first fixing cover portion and the second fixing cover portion were constituted of different members, the first fixing cover portion and the second fixing cover portion may be constituted of one member. In this case, this can be achieved by, for example, making the combined portion of the first fixing cover portion and the second fixing cover portion thin and bendable. The bendable structure between the first fixing cover portion and the second fixing cover portion can be achieved even by other structure, without use of the second axle. For example, the bendable structure between the first fixing cover and the second fixing cover can be achieved by combining the first fixing cover and the second fixing cover with a bendable adhesive tape.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A fixing device comprising:

a fixing device main body having an opening across a back portion and an upper portion of a conveying passage for a recording sheet; and a fixing cover openably/closably covering the main-body opening by being rotatably supported with a first axle as a rotational central axle, the first axle extending in a width direction of the recording sheet in a lower end of the back portion of the opening, wherein the fixing cover includes a first fixing cover portion that covers the back portion of the conveying passage, a lower end portion of the first fixing cover portion being rotatably supported with the first axle as the rotational central axle, a second fixing cover portion that covers the upper portion of the conveying passage, wherein the second fixing cover portion has a bendable structure with respect to the first fixing cover portion, a conveyance guide provided rotatably on a third axle, as the conveyance guide's rotational center axis, extending in the width direction, the third axle having an abutment at an inferior axial end thereof, and a pair of side covers, at least one of the side covers having a support region, wherein an abutment support area of the support region comes in contact with the abutment on the third axle such as to support the fixing cover, the abutment support area having a horizontal flat portion provided where the abutment on the third axle positions in state in which the fixing cover closes over the main-body opening, and having an inclined portion provided descending from an edge portion of the horizontal flat portion along an end of the abutment support area upstream with respect to recording-sheet travel.

2. The fixing device according to claim 1, wherein:

the first fixing cover portion includes a first fixing cover;

the second fixing cover portion includes a second fixing cover; and an end portion on a first fixing cover side in the second fixing cover is rotatably installed at an end portion on a second fixing cover side in the first fixing cover with a second axle extending in the width direction as a rotational central axle.

3. The fixing device according to claim 2, wherein the conveyance guide is located at an end portion on an opposite side with respect to the first fixing cover in the second fixing cover.

4. The fixing device according to claim 3, wherein the fixing cover includes rollers doubling as discharge rollers and switchback rollers.

5. The fixing device according to claim 4, wherein a plurality of the rollers are provided placed at intervals along the third axle's axis of extension.

6. An image forming apparatus comprising the fixing device according to claim 1.

7. The image forming apparatus according to claim 6, wherein a passage route of a recording sheet is a C-path type.

8. The fixing device according to claim 1, wherein the abutment on the third axle has an inferior surface that is arcuate.

* * * * *